United States Patent [19]

Tharp

[11] 4,008,503

[45] Feb. 22, 1977

[54] ROTARY SHOWER BRUSH

[76] Inventor: Marvin E. Tharp, 12629 - 56th St. West, Milan, Ill. 61264

[22] Filed: June 1, 1976

[21] Appl. No.: 691,503

[52] U.S. Cl. ..... 15/21 D; 4/158; 128/56

[51] Int. Cl.[2] ..... A46B 13/02; A61H 7/00

[58] Field of Search ..... 15/21 R, 21 B, 21 C, 15/21 D, 97; 128/56, 49, 50; 4/158

[56] References Cited

UNITED STATES PATENTS

| | | | |
|---|---|---|---|
| 2,876,765 | 3/1959 | Day | 15/21 D |
| 3,078,484 | 2/1963 | Briggs | 15/21 R |
| 3,085,269 | 4/1963 | Greer | 15/21 R |
| 3,862,459 | 1/1975 | Burnette | 15/21 D |

FOREIGN PATENTS OR APPLICATIONS

| | | | |
|---|---|---|---|
| 1,914,799 | 10/1970 | Germany | 15/21 D |
| 2,429,808 | 1/1976 | Germany | 128/56 |

*Primary Examiner*—Edward L. Roberts
*Attorney, Agent, or Firm*—Glenn H. Antrim

[57] ABSTRACT

A driven rotary brush is mounted on an adjustable plate, and the adjustable plate is mounted through rails and runners to a wall plate. The wall plate has quick mounting devices such as suction cups for quick attachment. The rails and runners provide easy vertical height adjustment. The brush has a central member functioning as a sprayer that is easily connected through flexible tubing to the supply pipe for the shower spray head.

2 Claims, 5 Drawing Figures

ROTARY SHOWER BRUSH

BACKGROUND OF THE INVENTION

This invention relates to rotary cleaning brushes driven by motors and particularly to rotary brushees used in showers for washing or massaging the backs of bathers.

Prior bathing devices have used rotary brushes with bristles about a tubular member. The tubular member has many small holes along its length so that it functions as a sprayer to direct water outwardly along the bristles of the brush. Other assemblies for showers use water directly from the spray heads of the showers in which they are installed. In order to accommodate bathers of different heights, the brushes have adjustable mountings to position the brushes at selected heights.

Prior bathing devices are generally bulky, expensive, and cannot be readily installed by the users. Special tools and skill are required for connecting the brushes to the water supplies, and extensive assembly and installation is required for installing the devices on or along the walls of the showers.

SUMMARY OF THE INVENTION

The present bathing device is compactly assembled on rectangular plates. A back plate or wall plate has suction cups for easily attaching the assembly to the wall of a shower. A front or adjustable plate is supported on the wall plate by two parallel runners. A brush, a motor for driving the brush, and a soap dispenser for applying soap to a tubular, axial member of the brush are mounted on the front side of the adjustable plate.

A main objective is to provide easy installation. Preferably, a fixture connected to the supply pipe of the shower provides easy connection through a flexible tube to the axial, spraying member of the brush. To connect the brush, the shower head is unscrewed from the supply pipe and a connector that is supplied with the bathing device is turned into the supply pipe. The fixture has a straight outlet into which the shower is turned and a side nipple to which the flexible tubing for supplying the brush is connected.

After the fixture for supply water is installed, the present shower assembly can be readily installed by pressing suction cups at the corners of the wall plate against the shower wall and then connecting the brush to the water supply. The wall plate is placed at such a height to accommodate a bather of average height when the adjustable plate is in a middle position. The height of the brush can then be adjusted for different bathers by merely releasing locking devices and moving the adjustable plate vertically over the wall plate.

DESCRIPTION OF THE PREFERRED EMBODIMENT

Figure 1:
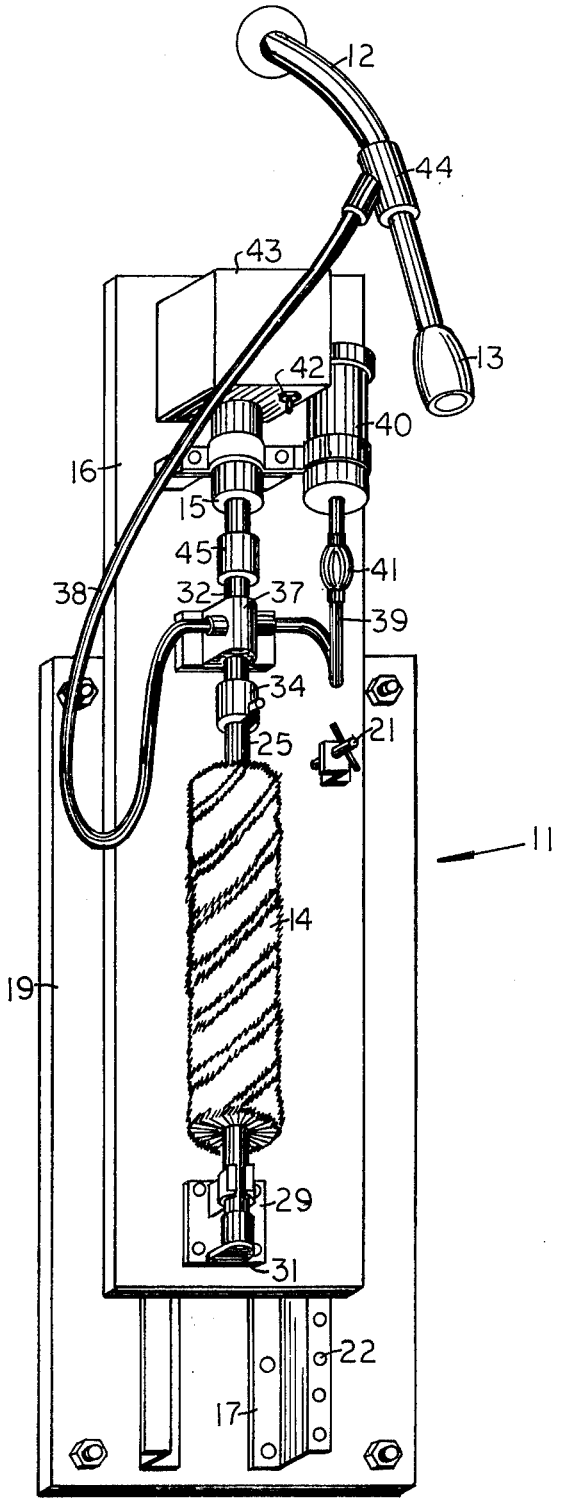
FIG. 1 is a front, oblique view of an installed rotary shower brush of this invention.
Figure 2:
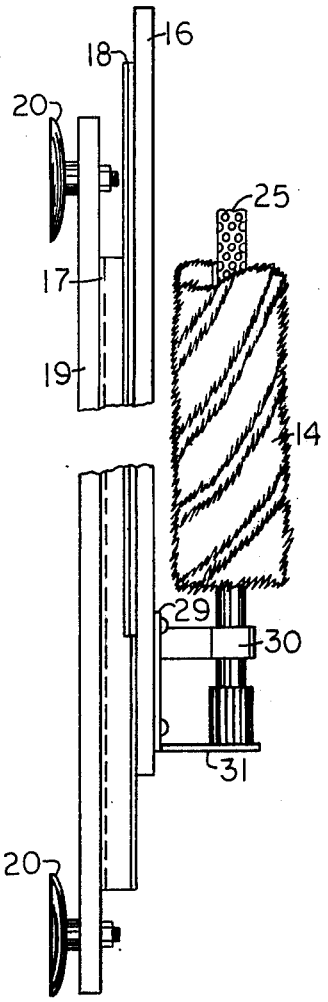
FIG. 2 is a fragmentary side view to show mounting means.

With reference to FIG. 1, a complete rotary shower brush assembly 11 is connected to a supply pipe 12 of a shower spray head 13. A cylindrical brush 14 and an electric motor 15 for rotating the brush are mounted on the front face of an adjustable mounting plate 16. This plate is connected through rails 17 and sliding runners 18 (FIGS. 2 and 3) to a rectangular wall plate 19. The plates 16 and 19 are made of lightweight plastic or metal materials, and their use with the rails 17 and the runners 18 provides a lightweight, vertically adjustable, rotary brush attachment that can be easily attached to the wall of a shower and to a water supply for the shower. Compact construction and the use of lightweight materials adapts the rotary brush attachment for easy installation of the wall plate 19 to a shower wall by application of pressure. As shown in FIG. 2, suction cups 20 that are placed near the corners of the wall plate 19 are used to mount the plate vertically at a convenient height on a wall of a shower near the shower head 13.

Figure 3:
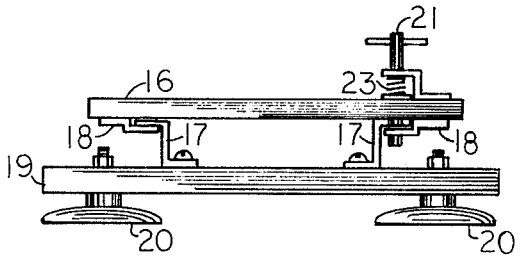
FIG. 3 is a cross-sectional view to show the mounting rails and runners.
Figure 4:
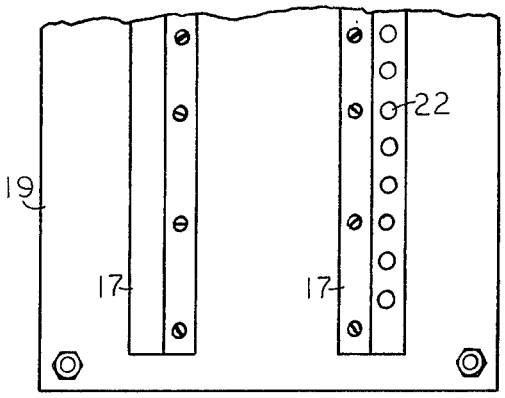
FIG. 4 is a fragmentary front view of a wall mounting plate for the rotary shower brush.

Various types of known rails and runners or riders can be used between the wall plate 19 and the adjustable mounting plate 16 to allow vertical adjustment of the height of the shower brush 14. In FIGS. 3 and 4, two rails 17 have a cross section with a step to provide elongated base portions to be connected to the front of the wall plate 19 and adjoining portions offset slightly from the wall plate 19 and turned outwardly to receive similarly shaped, vertical, parallel runners 18 fastened to the backside of the adjustable mounting plate 16. During installation, the wall plate 19 is fastened to a wall by the suction cups 20 to position the brush 14 at an average height while the adjustable mounting plate 16 is positioned about midway between the ends of its travel over the wall plate 19. With reference to FIGS. 1 and 3, a retaining pin 21 with a knob or crosspiece for pulling it out slightly is positioned to pass through the adjustable mounting plate 16, and into a selected one of the holes 22 (FIG. 1) spaced along one of the runners 17. A spring 23 bears inwardly on a retaining clip fastened to the pin 21 to hold it inwardly.

Figure 5:
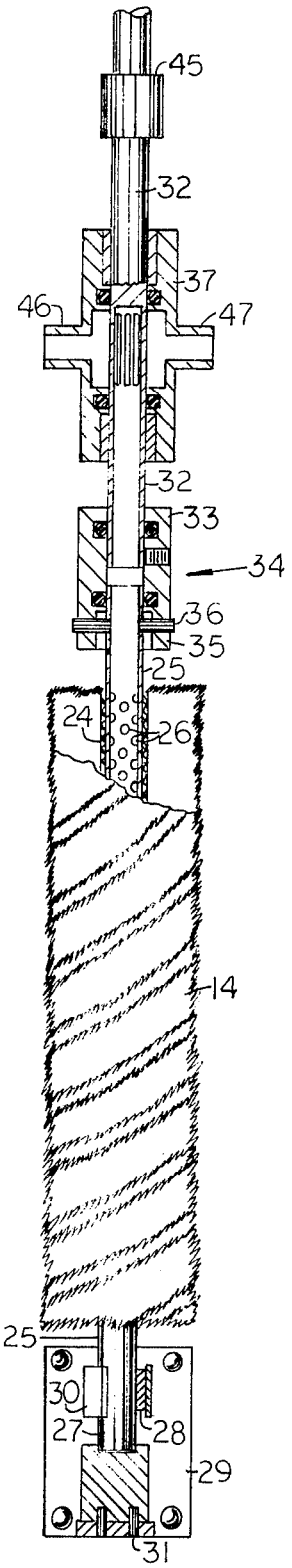
FIG. 5 is a fragmentary view of the brush assembly of the rotary shower brush.

The brush 14 shown in detail in FIG. 5 may comprise either bristles or fibers attached to an inner porous core 24 that is tied to a strong metal or plastic tube 25. For massaging, a brush with stiff bristles arranged in a spiral is preferred. The tube 25 has closely spaced, small holes 26 like a sprayer head for directing water radially outwardly into the bristles or fibers of the brush 14. The lower end of the tube 25 is closed and functions as a bearing surface in conjunction with an encircling sleeve bearing 28. The bearing 28 and the bearing portion 27 of the tube 25 is inserted in a holder 29 that permits the lower end of the brush 14 to be pulled outwardly for removal and replacement. A suitable spring clip 29 shown in FIG. 5 has a base portion to be fastened to the front side of the adjustable mounting plate 16, side members 30 that project outwardly and curve around the bearing 28 sufficiently to hold it in place, and an outwardly projecting lower support 31 against which the lower end of the tube 25 rests.

The upper end of the tubular member 25 of the brush 14 is connected through a quick-disconnect coupling 34, a short length of tubing 32, a coupling sleeve 45 to the shaft of the motor 15. The lower end of the tubing 32 is connected to an upper portion 33 of a quick-disconnect coupling 34. A lower portion 35 of the coupling 34 has an axial hole for receiving the open upper end of the tubular member 25 of the brush 14 and the lower end of the piece of tubing 32. The upper portion 33 may have a set screw to secure the coupling 34 to the lower end of the tubing 32. To prevent excessive leakage of water, appropriate seals between the parts are required. The upper end of the tubular member 25 is a sliding fit within the axial hole of the lower portion 35 of the coupling 34, and to prevent rotation, the lower end of the axial hole may have a pair of radial slots for receiving keying portions 36 extending radially from the upper end of the tubular member 25.

The piece of tubing 32 is provided with an encircling connector 37 and has its upper end closed and connected through the coupling 45 to the shaft of the motor 15. The tubing 32 has openings through its walls for communicating through the connector 37, the tubing 32, the coupling 34, and the tubular member 25 to the holes 26 of the brush 14. The connector 37 has a cylindrical wall with its inner surface spaced from the piece of tubing 32, and outside the openings through the wall of the tubuing 32 has seals between the ends of the cylindrical portion of the connector 37 and the piece of tubing 32. The connector 37 has one nipple 46 to which is connected a piece of flexible tubing 38 (FIG. 1) for connecting to the pressure water system and another nipple 47 connected to a piece of flexible tubing 39 for connecting to a soap receptacle 40. The tubing 38 can be conveniently connected to a Y-connector 44 connected to the supply pipe 12 of the shower spray head 13. The soap receptacle 40 is fastened to the adjustable mounting plate 16 at a position above and to the right of the brush 14. The bottom of the soap receptacle is connected through a resilient, squeeze bulb 41 to the tubing 39. A usual check valve is provided between the soap receptacle 40 and the squeeze bulb 41 and also between the squeeze bulb 41 and the connector 37 to permit soap from the receptacle 40 to be forced into the connector 37 and to prevent water under pressure from flowing into the soap receptacle 40. To improve appearance and to cover the rotating parts above the brush, a decorative plate may be supplied to fit between the motor 15 and the brush 14.

The motor 15 for driving the brush 14 is connected to a low-voltage cource of current. For safety, the motor 15 must be connected directly to house wiring. The motor 15 is connected through an on-off switch 42 to a source of power. Power can be supplied from batteries contained in the housing 43 or obtained through low-voltage wiring from a remote step-down transformer that provides a safe voltage to the motor 15.

The present arrangement of using two lightweight plates 16 and 19 coupled to permit sliding of one over the other for a predetermined distance results in a rotary shower brush that is easily installed and easily adjusted in height. While the adjustable mounting plate 16 is in a middle position with respect to the wall plate 19, the wall plate 19 through suction cups 20 or other easy connecting devices is attached near a shower attachment such that the brush 14 is suitable for a person of average height. The shower head 13 is removed from the supply pipe 12 and the connector 44 is connected between the pipe and the shower head. The connector 44 has a nipple for connecting the piece of tubing 38 between the supply pipe 12 and one of the nipples on the connector 37. The soap receptacle 40 is filled with liquid soap. To adjust the height of the brush for different bathers, the pin 21 is pulled outwardly, and the adjustable mounting plate 16 is moved vertically to the desired height. The flow of water through the tubing 38 to the tubular member 25 of the brush 14 is controlled by the usual valves used in controlling the flow of water through the shower head 13. When soap is to be injected into the stream of water that flows from the small holes 26 of the tubular member 25, the bather squeezes the bulb 41 to inject soap from the receptacle 40. The brushes are easily removed from replacement, and brushes having different degrees of stiffness can be installed according to the desires of the different bathers. A brush is removed by pulling outwardly on the lower end to disengage its lower bearing from the spring clip 29, and removing the upper end from the quick-disconnect coupling 34. The procedure is reversed for installation of a different brush.

I claim:

1. A rotary shower brush comprising:

a rotary brush assembly including an adjustable mounting plate adjustable in height, a generally cylindrical brush, bearing means on said adjustable mounting plate for rotatively supporting said brush vertically on the axis thereof near the front side of said adjustable mounting plate, motor means mounted to said adjustable mounting plate and coupled to said brush for rotating said brush about the axis thereof, a wall plate having on the back side thereof fastening means for readily fastening said wall plate to the wall of a shower by manual application of pressure, an adjustable supporting means having afixed member fastened to the front side of said wall plate and a mating movable member fastened to the back side of said adjustable mounting plate, said adjustable supporting means permitting said adjustable mounting plate to move along a line parallel to the face of said wall plate, said wall plate to be oriented to permit vertical positioning of said adjustable mounting plate on said adjustable supporting means, and stopping means for holding said adjustable mounting plate at a selected height on said adjustable supporting means.

2. A rotary shower brush according to claim 1 in which said brush has an axial tubular member that has holes as a water sprayer along the length of said brush, said motor being coupled to said axial tubular member, means for coupling said axial tubular member to a pressure water system, and means for fluidly coupling a soap receptacle to said axial tubular member, said last means including valve means operable to inject liquid soap from said soap receptacle into said tubular brush holder.

* * * * *